US009970598B2

(12) United States Patent
Tousain et al.

(10) Patent No.: US 9,970,598 B2
(45) Date of Patent: May 15, 2018

(54) LIGHTING DEVICE AND LUMINAIRE

(71) Applicant: PHILIPS LIGHTING HOLDING B.V., Einhoven (NL)

(72) Inventors: Robertus Leonardus Tousain, Shanghai (CN); Jean-Paul Jacobs, Shanghai (CN); Xiaoqing Duan, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 23 days.

(21) Appl. No.: 15/309,983

(22) PCT Filed: Apr. 28, 2015

(86) PCT No.: PCT/EP2015/059180
§ 371 (c)(1),
(2) Date: Nov. 9, 2016

(87) PCT Pub. No.: WO2015/169642
PCT Pub. Date: Nov. 12, 2015

(65) Prior Publication Data

US 2017/0138541 A1 May 18, 2017

(30) Foreign Application Priority Data

May 9, 2014 (CN) ..... PCT/CN2014/077177
May 22, 2014 (EP) ..... 14169405

(51) Int. Cl.
*F21V 23/06* (2006.01)
*F21K 9/232* (2016.01)
(Continued)

(52) U.S. Cl.
CPC ..... *F21K 9/232* (2016.08); *F21K 9/235* (2016.08); *F21K 9/237* (2016.08); *F21K 9/238* (2016.08);
(Continued)

(58) Field of Classification Search
CPC ..... F21K 9/232; F21K 9/235; F21K 9/237; F21K 9/238; F21V 23/06; F21V 25/00; F21V 25/02; F21V 25/04
(Continued)

(56) References Cited

U.S. PATENT DOCUMENTS 2,930,886 A * 3/1960 Lennan ..... F21L 4/00 200/60
2013/0286645 A1* 10/2013 Bukkems ..... F21K 9/90 362/227

FOREIGN PATENT DOCUMENTS

CN 102011994 A 4/2011
CN 102997193 A 3/2013
(Continued)

*Primary Examiner* — Elmito Breval
*Assistant Examiner* — Keith Delahoussaye

(57) ABSTRACT

There is provided a lighting device (100) comprising a housing comprising a frangible light exit window (110) and a fitting (120) including a first electrical connector (122) inside said housing. Within the housing there is a carrier assembly (130) comprising a plurality of SSL elements (132), and a second electrical connector (134) in contact with the first electrical connector (122). The second electrical connector (134) is held in contact with the first electrical connector (122) by the light exit window (110). This lighting device is relatively safe as if the light exit window (110) breaks the electrical components of the carrier assembly (130) may not be live.

12 Claims, 6 Drawing Sheets

(51) Int. Cl.

| | |
|---|---|
| ***F21V 3/02*** | (2006.01) |
| ***F21V 3/04*** | (2018.01) |
| ***F21K 9/237*** | (2016.01) |
| ***F21K 9/238*** | (2016.01) |
| ***F21V 25/00*** | (2006.01) |
| ***F21K 9/235*** | (2016.01) |
| *F21Y 115/10* | (2016.01) |

(52) U.S. Cl.
CPC ..... *F21V 3/02* (2013.01); *F21V 3/0418* (2013.01); *F21V 23/06* (2013.01); *F21V 25/00* (2013.01); *F21Y 2115/10* (2016.08)

(58) Field of Classification Search
USPC ..... 313/49–51; 362/235, 368–371
See application file for complete search history.

(56) References Cited

FOREIGN PATENT DOCUMENTS

| | | | | | |
|---|---|---|---|---|---|
| DE | 19927142 | C1 | * | 12/2000 | ..... F21V 23/06 |
| EP | 2339223 | A1 | | 6/2011 | |
| WO | 2005090852 | A2 | | 9/2005 | |

* cited by examiner

LIGHTING DEVICE AND LUMINAIRE

CROSS-REFERENCE TO PRIOR APPLICATIONS

This application is the U.S. National Phase application under 35 U.S.C. § 371 of International Application No. PCT/EP2015/059180, filed on Apr. 28, 2015, which claims the benefit of Chinese Patent Application No. PCT/CN2014/077177, filed on May 9, 2014 and European Patent Application No. 14169405.9, filed on May 22, 2014. These applications are hereby incorporated by reference herein.

FIELD OF THE INVENTION

The present invention relates to a lighting device, in particular to a lighting device comprising Solid State Lighting (SSL) elements.

The present invention also relates to a luminaire comprising the lighting device.

BACKGROUND OF THE INVENTION

With a continuously growing population, it is becoming increasingly difficult to meet the world's energy needs and, simultaneously, to control carbon emissions to kerb greenhouse gas emissions which are considered responsible for global warming phenomena. These concerns have triggered a drive towards a more efficient use of electricity in an attempt to reduce energy consumption.

One such area of concern is lighting applications, either in domestic or commercial settings. There is a clear trend towards the replacement of traditional, relatively energy-inefficient, light bulbs such as incandescent or fluorescent light bulbs with more energy efficient replacements. Indeed, in many jurisdictions the production and retailing of incandescent light bulbs has been outlawed, thus forcing consumers to buy energy-efficient alternatives, for example when replacing incandescent light bulbs.

A particularly promising alternative is provided by solid state lighting (SSL) devices, which can produce a unit luminous output at a fraction of the energy cost of incandescent or fluorescent light bulbs. An example of such a SSL element is a light emitting diode (LED).

It is known to provide SSL lighting devices having a similar overall shape to incandescent light bulbs, for example, bulbous solid state lighting devices. Such devices can provide an appearance that is comparable with traditional lighting devices which can aid market penetration as customers may like or be accustomed to the appearance of incandescent light bulbs. These bulbous SSL devices may be used to replace incandescent light bulbs or used in similar applications to incandescent light bulbs. In particular, these SSL lighting devices may be particularly easy to retro-fit in place of incandescent light bulbs.

An example of a prior art bulbous SSL element-based lighting device comprises SSL elements mounted within the same glass bulb as used for incandescent bulbs. However, if the glass breaks the device may still be operable, even though the glass is broken, such that the user may be exposed to parts of the lamp carrying a high current and/or voltage. If a user then touches these parts there is a significant risk of electrical shock, which is potentially harmful.

DE19927142C1 discloses an automobile reflector lamp which has light source mounted on rear side of transparent carrier plate facing towards rear reflector. The contacts for the light source provided by the carrier plate brought into contact with counter-contacts when the carrier plate is fitted in the lamp. Helicoidal springs are used as contacts for ensuring sufficient contact pressure. However, safety issue is not considered and there is still potential risk of electrical shock when the lamp glass is broken due to the exposed contacts.

SUMMARY OF THE INVENTION

The invention provides a lighting device comprising: a housing comprising a frangible light exit window and a fitting including a first electrical connector inside said housing; and a carrier assembly within the housing comprising: a plurality of SSL elements, and a second electrical connector in contact with the first electrical connector, wherein the second electrical connector is held in contact with the first electrical connector by the light exit window.

When the light exit window is intact the housing can help to shield the user from electric shock by the live components of the carrier assembly. As the second electrical connector is held in contact with the first electrical connector by the light exit window, the carrier assembly may no longer be live if the light exit window is broken such that the carrier assembly does not present an electric shock hazard to a user. Accordingly, such a lighting device may be particularly safe.

The light exit window may be bulbous. This can provide an appearance that is comparable with traditional incandescent light bulbs and accordingly aid market penetration.

The light exit window may be of glass. Use of glass may be particularly economic, in particular, it may be available relatively cheaply and may be handled using techniques familiar to those working in the field of lighting devices.

The lighting device may further comprise a compressed resilient element for forcing apart the first electrical connector and the second electrical connector when the frangible light exit window is broken or removed. Such a compressed resilient element can assist in breaking the electrical connection between the first electrical connector and the second electrical connector in the event of the light exit window breaking. The resilient element is not electrically connected to any one of the connectors or any other electrically live parts of the lighting device, so, there is no safety risk even a user touch the resilient element.

The resilient element may comprise a spring. For example, the resilient element may comprise a coil spring.

The lighting device may further comprise an electrically insulating spacer between the resilient element and the first and/or the second electrical connectors, said electrically insulating spacer enveloping at least a part of the resilient element. This can prevent the compressed resilient element from shorting electrical connections, for example between two poles of the first electrical connector.

The lighting device may further comprise a safety cover within the housing for preventing a user from contacting the first electrical connector. This can help to prevent electric shocks to the user by shielding the first electrical connector from the user in the event of the light exit window breaking.

The safety cover may be of a plastics material.

The first electrical connector may comprise two leaf springs. The springs may enable good electrical contact between the first electrical connector and the second electrical connector by forcing the carrier assembly against the light exit window.

The light exit window may comprise a protuberance for mating with the carrier assembly extending into the housing, and wherein the carrier assembly is held in contact with the first electrical connector by the protuberance. This can help to maintain good electrical contact between the first electrical connector and the second electrical connector whilst the light exit window is intact.

The carrier assembly may comprise a main portion and an adapter extending from the main portion to the light exit window. This can provide increased design flexibility, as the main portion can have any size smaller than the required carrier assembly size, only the size of the adapter needs to be adjusted. Accordingly, the designer is provided with fewer restraints in the choice of a main portion of the carrier assembly.

The carrier assembly may comprise a printed circuit board.

The lighting device may comprise a driver.

The driver may be mounted on the carrier assembly.

Alternatively, the driver may be mounted on or in the fitting.

The second electrical connector may comprise electrical contact pins. Electrical contact pins may be relatively economic and relatively easily mounted on the carrier assembly.

The invention also provides a luminaire comprising the lighting device as described above. Because, as described above, the lighting device may be relatively safe, the luminaire comprising the lighting device may also be relatively safe.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
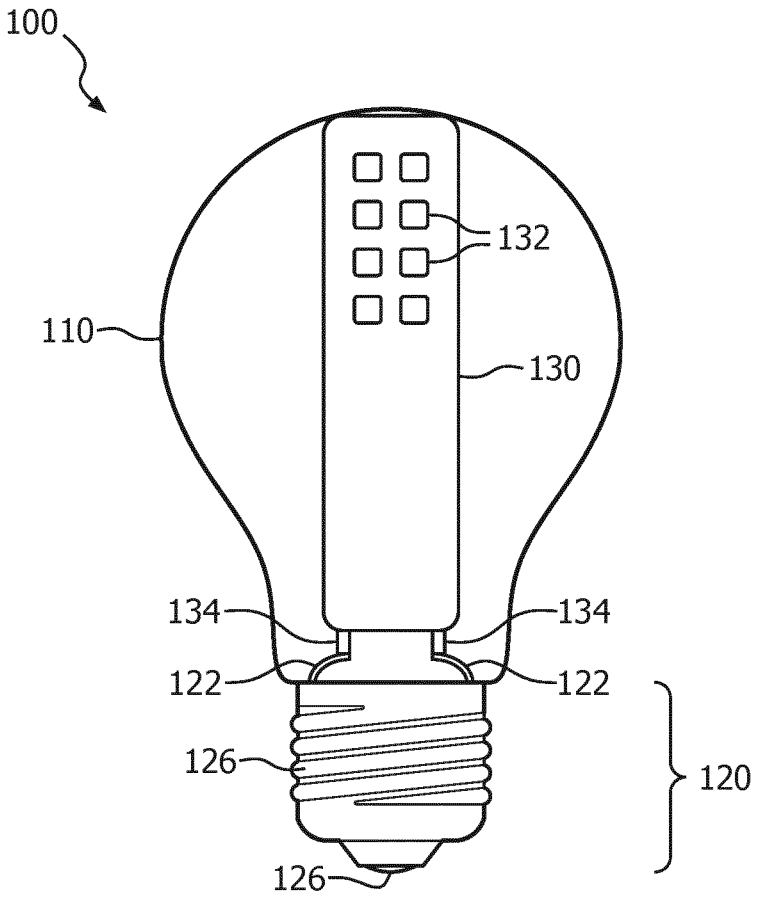
FIG. 1 depicts a schematic cross-section of a lighting device according to an embodiment of the present invention.

It should be understood that the Figures are merely schematic and are not drawn to scale. It should also be understood that the same reference numerals are used throughout the Figures to indicate the same or similar parts.

Embodiments of the present invention are concerned with SSL element-based lighting devices. A particular safety concern of such lighting devices is that upon fracturing of a frangible housing such as a glass housing, the electrical components such as the SSL elements internal to the housing may remain live, thereby potentially exposing a user to electrical shock upon touching the live electrical components.

Referring firstly to FIG. 1 of the accompanying drawings, a lighting device 100 comprises a housing including a frangible light exit window 110 and a fitting 120. The fitting 120 includes a first electrical connector 122 which is inside the housing. There is also a carrier assembly 130 within the housing. The carrier assembly 130 comprises a plurality of SSL elements 132 and a second electrical connector 134. The second electrical connector 134 is held in contact with the first electrical connector 122 by the light exit window 110.

Figure 2:
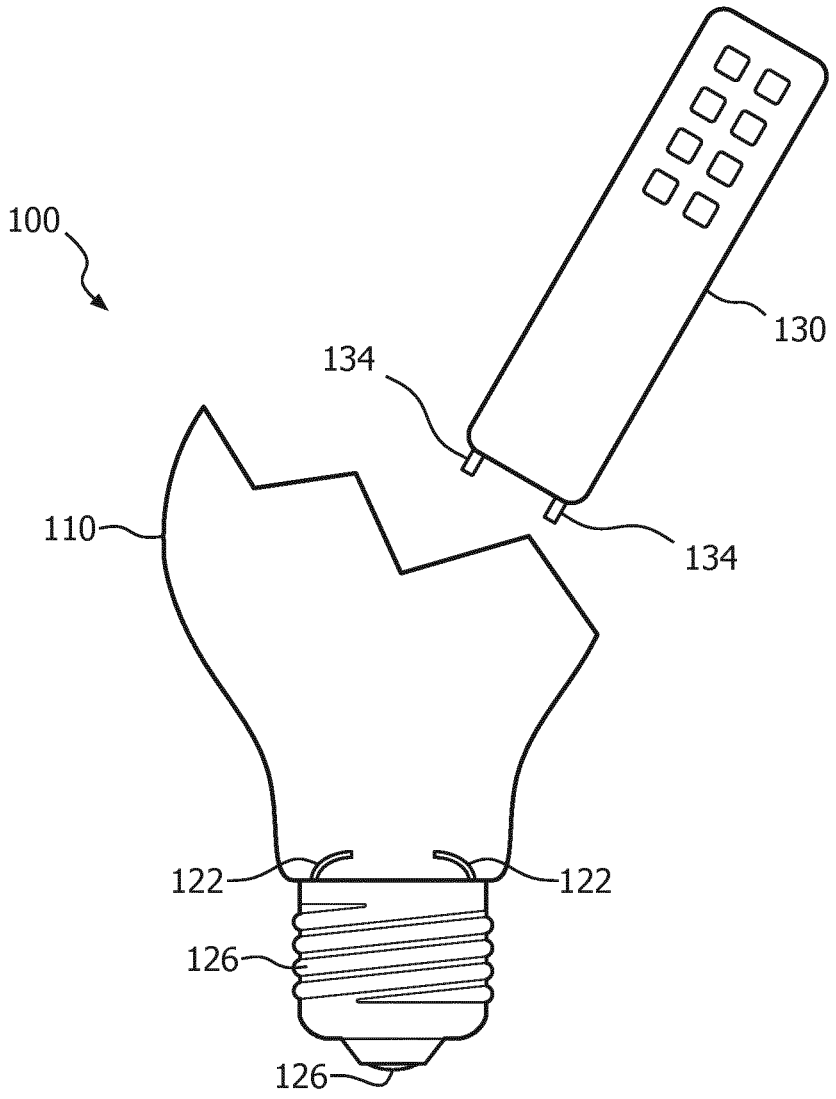
FIG. 2 depicts schematically the lighting device of FIG. 1 wherein the light exit window of the lighting device is broken.

Consequently, in the lighting device 100, if the light exit window 110 is broken the second electrical connector 134 is no longer held in contact with the first electrical connector 122 by the (broken) light exit window 110, thus causing the contact between the second electrical connector 134 and the first electrical connector 122 to be disrupted, such that the carrier assembly 130 is no longer electrically live. Accordingly, the carrier assembly 130 does not present an electric shock hazard to a user if the light exit window 110 is broken. This is illustrated in FIG. 2, where it can be seen that the second electrical connector 134 is no longer in contact with the first electrical connector 122, accordingly the carrier assembly 130 is not electrically live when the light exit window 110 of the housing is broken.

Of course, as illustrated in FIG. 1, when the carrier assembly 130 is within the housing of the lighting device 100 and the housing is intact a user is prevented from contacting the live carrier assembly 130 of the lighting device 100 by the housing.

From the prior art, it is known to use electrically isolating drivers to provide lighting devices which are relatively safe in case of a breakage of a light exit window. However, isolating drivers are relatively expensive, whereas the lighting device 100 may be relatively simple and therefore relatively economic. It is also known to encapsulate the live electrical parts, in for example plastic or rubber coatings, however this may be relatively costly and cumbersome and may negatively impact on luminous performance.

In selected embodiments, the solid state lighting (SSL) elements 132 may be Light Emitting Diodes (LEDs). Each of the SSL elements 132 may emit light of the same colour; alternatively, the SSL elements may be configured to emit light of differing colours in order to provide a desired effect, as is known to the skilled person. For instance, such colours may mix inside the housing to yield a luminous output of a desired colour.

The light exit window 110 may be bulbous. This can provide an appearance that is comparable with traditional lighting devices, such as incandescent light bulbs. An appearance that is similar to traditional lighting devices may aid market penetration of the lighting device, as customers may like or be accustomed to the appearance of such traditional lighting devices.

The light exit window 110 may be of glass. Glass is a material which may be available relatively cheaply. Also glass may be handled relatively easily using techniques which are familiar to those who manufacture lighting devices.

The first electrical connector 122 may comprise sprung elements. Sprung elements may enable good electrical contact between the first electrical connector 122 and the second electrical connector 134 by forcing the carrier assembly 130 against the light exit window 110 such that there is good mechanical contact between the first electrical connector 122 and the second electrical connector 134. For example, the first electrical connector 122 may comprise two leaf springs. Leaf springs may be relatively economic electrical connections.

The second electrical connector 134 may comprise electrical contact pins. Electrical contact pins may be relatively economic electrical connectors. Further, electrical contact pins may be relatively easy to mount on the carrier assembly 130. Alternatively, the second electrical connector 134 may comprise sprung elements, such as leaf springs, this can provide similar advantages as if the first electrical connector 122 comprises sprung elements, as described above, specifically, it can help to ensure good electrical contact between the first and second electrical connectors 122, 134.

As will be apparent, one or both of the first and second electrical connectors 122, 134 may comprise sprung elements which can help to ensure good electrical contact between the connectors 122, 134.

The fitting 120 may comprise a third electrical connector 126. The third electrical connector 126 is for supplying the lighting device 100 with electrical power. The third electrical connector 126 may be any electrical connector, for example an Edison screw fitting or a bayonet fitting, or any other suitable electrical connector as may occur to the skilled person.

Figure 4:
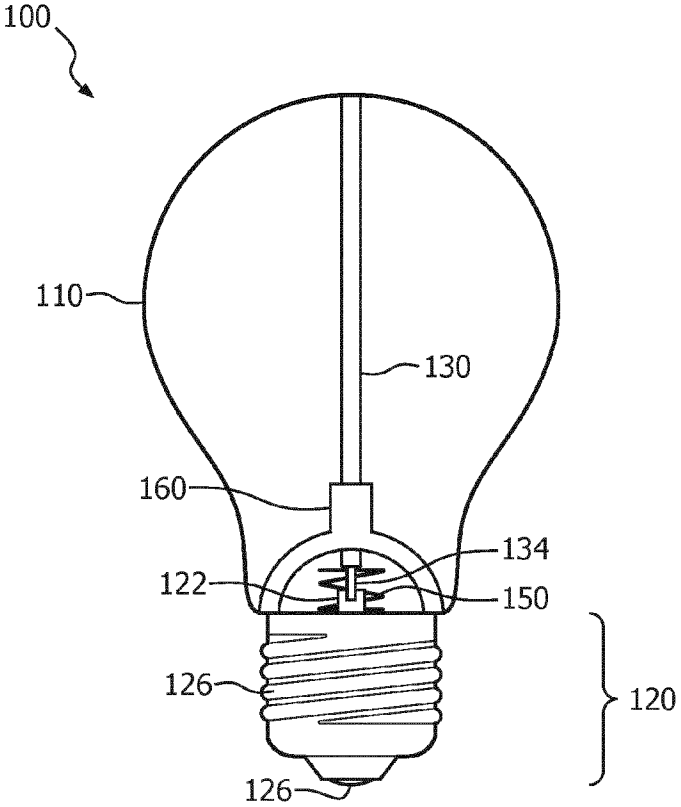
FIG. 4 depicts a schematic alternative cross-section of the lighting device of FIG. 3.
Figure 3:
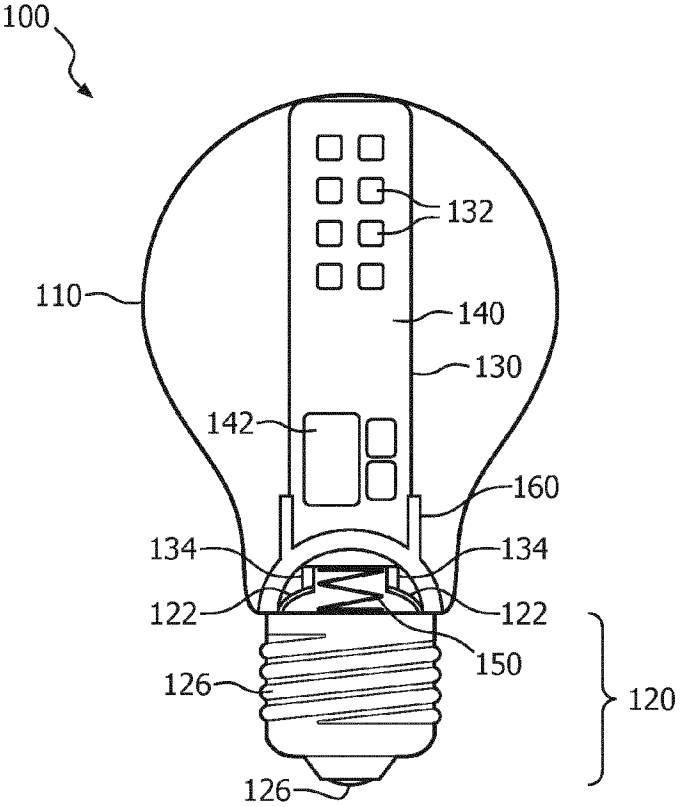
FIG. 3 depicts a schematic cross-section of a lighting device according to another embodiment of the present invention.
Figure 5:
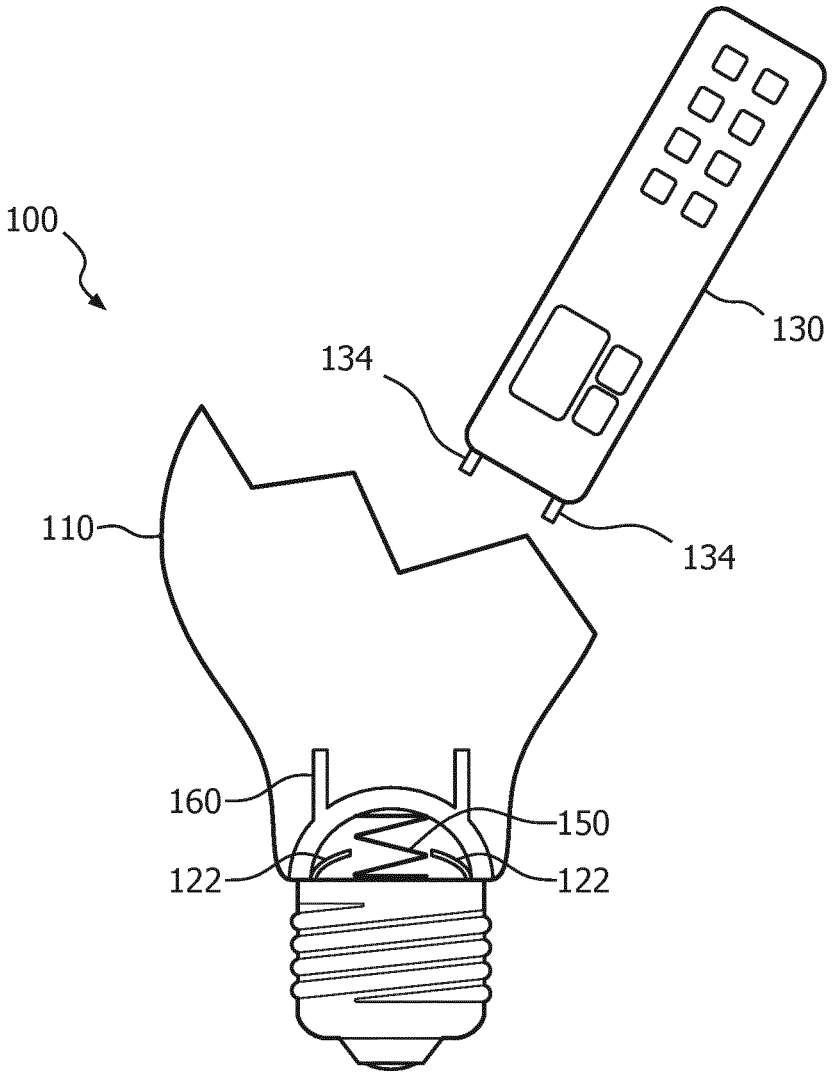
FIG. 5 depicts schematically the lighting device of FIG. 3 wherein the light exit window of the lighting device is broken.

FIGS. 3, 4 and 5 illustrate another embodiment of a lighting device 100. This embodiment is substantially similar to the embodiment described above with reference to FIGS. 1 and 2, accordingly, only the differences will be described.

As shown in FIGS. 3 and 4, the lighting device 100 may further comprise a compressed resilient element 150 for forcing apart the first electrical connector 122 and the second electrical connector 134 when the frangible light exit window 110 is broken or removed. This compressed resilient element 150 can therefore assist in breaking the electrical connection between the first electrical connector 122 and the second electrical connector 134 such that if the light exit window 110 is broken the carrier assembly 130 does not present an electric shock hazard to a user. This is illustrated in FIG. 5 which illustrates the lighting device of FIGS. 3 and 4 wherein the light exit window 110 is broken. It can be seen that the second electrical connector 134 is no longer in contact with the first electrical connector 122 because the connectors 122, 134 have been forced apart by the resilient element 150, accordingly the carrier assembly 130 is not electrically live. It can also be seen in FIG. 5 that the resilient element 150 has expanded in order to assist with breaking the electrical contact between the first electrical connector 122 and the second electrical connector 134. The resilient element 150 is not electrically connected to any one of the connectors or any other electrically live parts of the lighting device, so, there is no safety risk even a user touch the resilient element 150.

The compressed resilient element 150 may comprise a spring, for example a compression coil spring. Such springs may be particularly suitable as they may be available relatively economically and typically retain their resilience beyond the lifetime of the lighting device.

As shown in FIGS. 3 and 4, the lighting device 100 may further comprise a safety cover 160 within the housing for preventing a user from contacting the first electrical connector 122. The first electrical connector 122 may remain live when the frangible light exit window 110 is broken; although, as discussed above, the construction of the lighting device can reduce the electric shock hazard from the carrier assembly 130, the first electrical connector 122 may still present an electric shock hazard. Accordingly, a safety cover 160 may be provided to prevent a user from contacting the, potentially live, first electrical connector 122 in the event of the window 110 breaking, in order to provide a safer device. The safety cover 160 receives the carrier assembly 130 and allows the second electrical connector 134 of the carrier assembly 130 to contact the first electrical connector 122, however, a user is prevented from contacting the first electrical connector 122 in the event of the light exit window breaking.

The safety cover 160 may be of a plastics material or any other suitable electrically insulating material. Plastics materials may be particularly economic.

The carrier assembly 130 may comprise a printed circuit board 140. A printed circuit board (PCB) is a convenient way of supplying electricity from the electrical connectors 122, 134 to the solid state lighting elements 132. The printed circuit board 140 may be of materials commonly used in the art and manufactured according to such procedures as are known to the skilled person. Of course, the carrier assembly of the embodiments described above with reference to FIGS. 1 and 2 may also comprise a PCB.

The lighting device 100 may further comprise a driver 142. The driver 142 may be mounted on the carrier assembly 130, as shown in FIG. 3. For example, the driver 142 may be mounted on the printed circuit board 140. Alternatively, the driver may be mounted on the fitting 120. If a driver 142 is not provided as part of the lighting device 100, then a driver may be provided as part of a luminaire or in some other way external to the lighting device 100.

Figure 6:
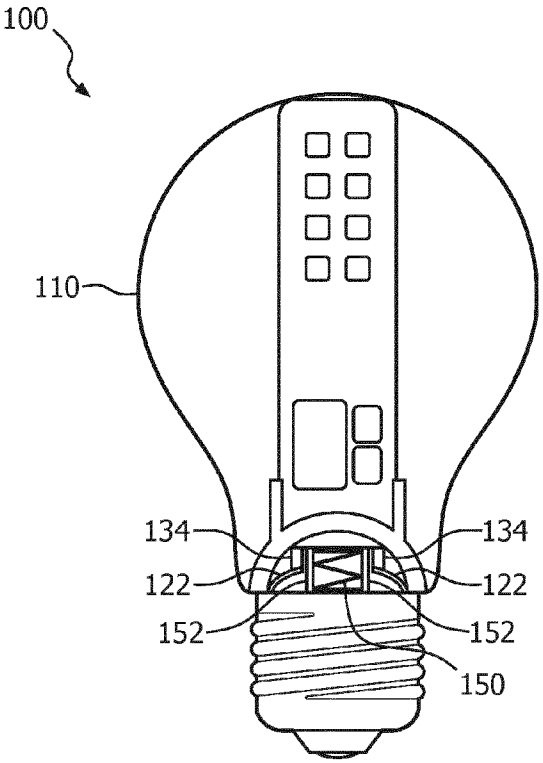
FIG. 6 depicts a schematic cross-section of a lighting device according to another embodiment of the present invention.

FIG. 6 illustrates another embodiment of a lighting device 100. This embodiment is substantially similar to the embodiments described above, accordingly, only the differences will be described.

The lighting device 100 may further comprise an electrically insulating spacer 152. The electrically insulating spacer 152 envelopes at least a part of the resilient element 150 and is located between the resilient element and the first and/or the second electrical connectors 122, 134. The electrically insulating spacer 152 is for preventing the compressed resilient element 150 from shorting electrical connections, for example shorting between two poles of the first electrical connector 122. Use of such a spacer 152 may be advantageous where the compressed resilient element 150 is an electrically conducting spring, for example a metallic spring. Alternatively, it may be desired to provide an electrically insulating compressed resilient element 150, for example of a plastics material, in order to avoid said shorting.

Figure 7:
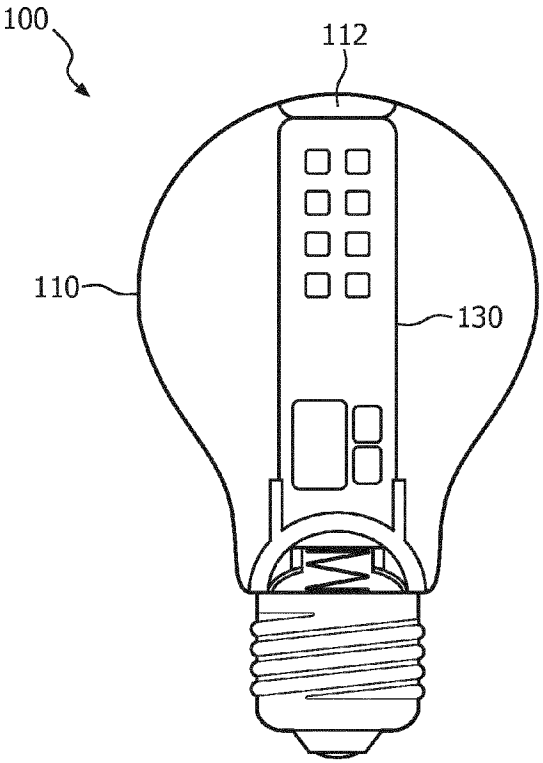
FIG. 7 depicts a schematic cross-section of a lighting device according to another embodiment of the present invention.

FIG. 7 illustrates another embodiment of a lighting device 100. This embodiment is substantially similar to the embodiments described above, accordingly, only the differences will be described.

The light exit window 110 of the lighting device 100 may further comprise a protuberance 112 for mating with the carrier assembly 130. The protuberance 112 extends into the housing and the first electrical connector 122 of the carrier assembly 130 is held in contact with the first electrical connector by the protuberance 112. The protuberance 112 can help to provide a particularly stable electrical contact between the first electrical connector 122 and the second electrical connector 134. For example, as illustrated in FIG. 7 the protuberance 112 may have a flat surface which mates with a corresponding flat surface of the carrier assembly 130. As a further example, the protuberance 112 may comprise a groove for receiving a leading edge of the carrier assembly 130, such a groove may ensure a good fit between the carrier assembly 130 and the light exit window 110. Other suitable complementary shapes between the protuberance 112 on the one hand and the leading edge of the carrier assembly 130 on the other hand in order to achieve a stable interaction between the protuberance 112 and the leading edge of the carrier assembly 130 will be apparent to the skilled person.

Figure 8:
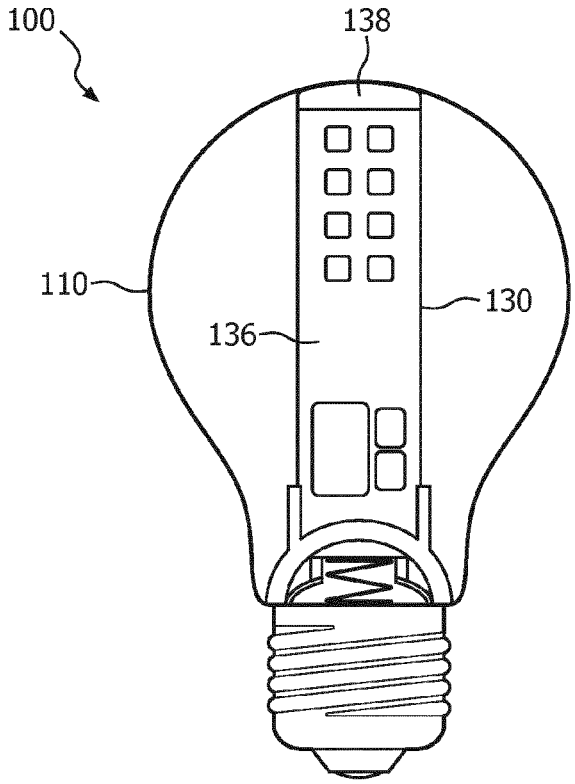
FIG. 8 depicts a schematic cross-section of a lighting device according to another embodiment of the present invention.

FIG. 8 illustrates another embodiment of a lighting device 100. This embodiment is substantially similar to the embodiments described above, accordingly, only the differences will be described.

The carrier assembly 130 of the lighting device 100 may comprise a main portion 136 and an adapter 138 extending from the main portion 136 to the light exit window 110. This can allow the use of multiple differently sized carriers 130, whilst only having to vary the dimensions of the adapter 138 and not the rest of the lighting device 100. The adapter 138, for example a piece of plastic, may be cut to size to make differently sized carriers 130 fit against the light exit window 110. It will be appreciated that it may be easier to resize or choose adapters 138 rather than the main portion 136 of the carrier assembly 130, such that the designer is provided with fewer restraints in the choice of a main portion 136 of the carrier assembly 130. Accordingly, use of such an adapter 138 can help to ensure good electrical contact between the first electrical connector 122 and the second electrical connector 134 in a relatively simple and therefore potentially cost-effective way.

Further, the adapter 138 may be shaped to match the light exit window 110, for example the adapter 138 may have an arcuate surface which mates with the light exit window 110.

Figure 9:
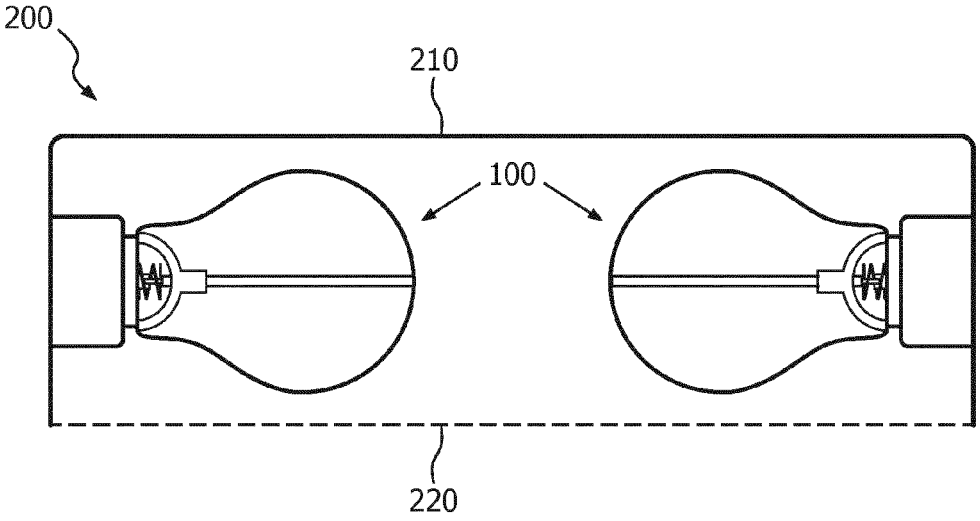
FIG. 9 depicts a schematic cross-section of a luminaire according to an embodiment of the present invention.

FIG. 9 illustrates that the lighting device 100 according to any embodiment of the invention may be advantageously included in a luminaire 200 such as a holder of the lighting device 100, for example a ceiling light fitting, an armature for fitting underneath a cabinet or the like, an apparatus into which the lighting device is integrated, for example a cooker hood or the like, and so on. FIG. 9 schematically depicts a luminaire 200 comprising a plurality of lighting devices 100 fitted in a housing 210 of the luminaire 200. The luminaire 200 comprises a light exit window 220. The light exit window 220 may optionally comprise beam shapers such as one or more lens arrays, reflectors and so on. Alternatively, the light exit window 220 may simply be formed by an opening in the housing 210. The internal surfaces of the housing 210 may be reflective to reflect light that exits the lighting devices 100.

The solid state lighting elements 132 of the lighting devices 100 may face the light exit window 220 of the luminaire 200. Alternatively, the lighting devices 100 may be mounted in the luminaire 200 such that the solid state lighting elements 132 face away from the light exit window 220. If the solid state lighting elements 132 face away from the light exit window 220 then the internal surfaces of the housing 210 should be reflective to reflect light that exits the lighting devices 100 towards the light exit window 220 of the luminaire 200.

In a non-limiting example, the luminaires 200 may be ceiling armatures, for example armatures that are integrated in a suspended ceiling. Other examples of such luminaires 200 will be apparent to the skilled person.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising:

a housing comprising a frangible light exit window and a fitting including a first electrical connector inside said housing;

a carrier assembly within the housing comprising:

a plurality of SSL elements, and a second electrical connector in contact with the first electrical connector, wherein the second electrical connector is held in contact with the first electrical connector by the light exit window;

a compressed resilient element for forcing apart the first electrical connector and the second electrical connector when the frangible light exit window is broken or removed;

a safety cover within the housing for preventing a user from contacting the first electrical connector; and an electrically insulating spacer between the resilient element and at least one of the first and the second electrical connectors, said electrically insulating spacer enveloping at least a part of the resilient element.

2. The lighting device according to claim 1, wherein the light exit window is bulbous.

3. The lighting device according to claim 1, wherein the light exit window is of glass.

4. The lighting device according to claim 1, wherein the resilient element comprises at least one of a spring and a coil spring.

5. The lighting device according to claim 1, wherein the safety cover is of a plastics material.

6. The lighting device according to claim 1, wherein the first electrical connector comprises two leaf springs.

7. The lighting device according to claim 1, wherein the light exit window comprises a protuberance for mating with the carrier assembly extending into the housing, and wherein the second electrical connector of the carrier assembly is held in contact with the first electrical connector by the protuberance.

8. The lighting device according to claim 1, wherein the carrier assembly comprises a main portion and an adapter extending from the main portion to the light exit window.

9. The lighting device according to claim 1, wherein the carrier assembly comprises a printed circuit board.

10. The lighting device according to claim 1, further comprising a driver, wherein the driver is mounted on the carrier assembly or the fitting.

11. The lighting device according to claim 1, wherein the second electrical connector comprises electrical contact pins.

12. A luminaire comprising the lighting device of claim 1.

* * * * *